US008844195B2

(12) United States Patent
Cox et al.

(10) Patent No.: US 8,844,195 B2
(45) Date of Patent: Sep. 30, 2014

(54) FIRE SHUTTER

(71) Applicant: Cox Architects Pty Ltd, Windsor (AU)

(72) Inventors: David Leonard Cox, Windsor (AU); Gregory Donald Chapman, Everton Park (AU)

(73) Assignee: Cox Architects Pty Ltd, Windsor (AU)

( * ) Notice: Subject to any disclaimer, the term of this patent is extended or adjusted under 35 U.S.C. 154(b) by 0 days.

(21) Appl. No.: 13/778,995

(22) Filed: Feb. 27, 2013

(65) Prior Publication Data

US 2013/0227891 A1 Sep. 5, 2013

Related U.S. Application Data

(63) Continuation-in-part of application No. 13/166,071, filed on Jun. 22, 2011, now abandoned.

(30) Foreign Application Priority Data

Jun. 22, 2010 (AU) ..... 2010100647

(51) Int. Cl.
*E05F 15/20* (2006.01)

(52) U.S. Cl.
USPC ..... 49/7

(58) Field of Classification Search
USPC ..... 49/366, 367, 369, 63, 61, 67, 1, 5, 7, 8; 52/202, 203
See application file for complete search history.

(56) References Cited

U.S. PATENT DOCUMENTS

| | | | | |
|---|---|---|---|---|
| 572,804 | A | | 12/1896 | Ireland |
| 1,379,537 | A | | 5/1921 | Davis |
| 1,387,479 | A | | 8/1921 | Dutcher |
| 1,635,537 | A | | 7/1927 | Clarke |
| 1,757,048 | A | | 5/1930 | Janeczko |
| 1,925,817 | A | | 9/1933 | Plym |
| 1,973,645 | A | | 9/1934 | McGilvray |
| 2,004,674 | A | | 6/1935 | Quisenberry |
| 2,330,696 | A | | 9/1943 | Exiner |
| 2,582,540 | A | | 1/1952 | Gruse |
| 2,598,817 | A | | 6/1952 | Mohring |
| 2,804,658 | A | | 9/1957 | Hoenicke |
| 3,557,497 | A | * | 1/1971 | Schafer et al. ..... 52/1 |
| 3,919,808 | A | | 11/1975 | Simmons |
| 4,039,018 | A | | 8/1977 | De Maria |
| 4,057,936 | A | | 11/1977 | Wyatt, Jr. et al. |
| 4,068,417 | A | * | 1/1978 | Anghinetti et al. ..... 52/1 |
| 4,423,574 | A | | 1/1984 | Pierre |
| 4,454,691 | A | | 6/1984 | Mitchell |
| 4,578,900 | A | * | 4/1986 | Hannay ..... 49/5 |
| 4,583,324 | A | | 4/1986 | Storz et al. |
| 4,653,229 | A | | 3/1987 | Feucht et al. |

(Continued)

FOREIGN PATENT DOCUMENTS

DE 3518724 A1 11/1987

*Primary Examiner* — Jerry Redman
(74) *Attorney, Agent, or Firm* — Lando & Anastasi, LLP

(57) ABSTRACT

A fire shutter for protecting an opening 10, such as a window 12, having one or more (typically two) fire resistant panels 20 and 21. The panels are hinged along a horizontal portion of the opening such that at least one of the panels can be utilized as an awning when open. The panel(s) have an insulating core that typically provides thermal insulation from the elements and increases fire resistance from fires (such as bushfires) to provide a fire rated shutter that meets the highest building fire standards.

16 Claims, 8 Drawing Sheets

(56) References Cited

U.S. PATENT DOCUMENTS

| | | | | |
|---|---|---|---|---|
| 4,663,904 | A | 5/1987 | Glenn | |
| 4,937,978 | A | 7/1990 | Johansson et al. | |
| 5,061,022 | A | 10/1991 | Meriwether | |
| 5,199,216 | A | 4/1993 | Vetter et al. | |
| 5,582,472 | A * | 12/1996 | Lyons et al. | 312/324 |
| 5,927,012 | A * | 7/1999 | Cermola et al. | 49/141 |
| 6,425,211 | B1 * | 7/2002 | Wise et al. | 52/1 |
| 6,484,784 | B1 * | 11/2002 | Weik et al. | 160/7 |
| 6,877,278 | B2 | 4/2005 | Karkkainen et al. | |
| H2133 | H | 11/2005 | Sorathia | |
| 7,028,431 | B2 * | 4/2006 | Tlemcani et al. | 49/8 |
| 7,217,753 | B2 | 5/2007 | Sinclair et al. | |
| 7,574,826 | B2 * | 8/2009 | Evans | 49/8 |
| 7,591,102 | B1 * | 9/2009 | Evans | 49/7 |
| 7,652,087 | B2 | 1/2010 | Dimanshteyn et al. | |
| 7,802,606 | B2 | 9/2010 | Landry | |
| 7,828,995 | B2 | 11/2010 | Kruse et al. | |
| 7,897,235 | B1 | 3/2011 | Locher et al. | |
| 8,109,659 | B2 | 2/2012 | Doubek | |
| 2001/0025450 | A1 | 10/2001 | Juntunen et al. | |
| 2003/0159373 | A1 | 8/2003 | Lien | |
| 2004/0045219 | A1 * | 3/2004 | Tlemcani et al. | 49/7 |
| 2012/0060436 | A1 | 3/2012 | Zimmer, II | |
| 2013/0305607 | A1 * | 11/2013 | Balbo Di Vinadio | 49/1 |

* cited by examiner

FIRE SHUTTER

RELATED APPLICATION

This application is a Continuation-In-Part of U.S. patent application Ser. No. 13/166,071, filed on Jun. 22, 2011, now abandoned, entitled "FIRE SHUTTER", which claims priority under 35 U.S.C. §119(a)-(d) to Australian Application No. AU 2010100647, filed on Jun. 22, 2010, entitled "AN IMPROVED FIRE SHUTTER," both of which are hereby incorporated by reference in its entirety for all purposes.

FIELD OF THE INVENTION

The invention relates to fire shutters and, more particularly to horizontally hinged, vertically opening, fire shutters comprising a thermally insulating material.

BACKGROUND ART

Fires, in particularly bushfires, can be a hazard to buildings/dwellings. Typically, such fires penetrate the weakest points of a building first and, once inside, can often find fuel to encourage the fire. This posses a significant threat to both the building/dwelling, the effects contained therein, and, more importantly, any people that may be inside.

One such weak point is in openings in the walls of the building, typically windows. Glass can easily be broken, particularly under extreme temperatures and, furthermore, is a poor thermal insulator meaning that radiant heat can still enter the building. To address this problem, shutters for windows can be utilised to cover the window. The shutters typically cover the window and are usually made of metal. When not in use, the shutters are usually stored on the sides of the window, or rolled into a roller assembly (e.g. much like a roller garage door).

Although a vast improvement on having no shutters, such shutters can conduct a significant amount of heat during a fire, and typically have little or no use when not protecting the opening/window from a fire, and are unsightly when not in their storage position.

It is an aim of this invention to provide an improved fire shutter which overcomes or ameliorates one or more of the disadvantages or problems described above, or which at least provides a useful alternative.

SUMMARY OF THE INVENTION

According to an aspect of the invention, there is provided a fire shutter for an opening, the fire shutter comprising:

at least one fire resistant panel having an insulating core, wherein the at least one panel is hinged along a horizontal portion of the opening, and is configured to cover the opening in a closed state and to be configurable as an awning in an open state.

The insulating core preferably substantially traverses the surface area of the panel, and in a preferred embodiment substantially fills an interior of the panel. The panel preferably has a hard outer casing or shell. The hard outer casing or shell may be made of any suitable, preferably fire resistant/proof material, such as a metal (preferably steel).

Preferably the insulating core comprises phenolic foam. In an embodiment, the insulating core comprises a mixture of phenolic foam and polystyrene, preferably polystyrene beads. In a preferred embodiment, the insulating core comprises a product known as RMAX POLYPHEN which, when in a steel clad 'sandwich' panel can achieve the highest criteria for fire hazard properties of building materials and assemblies under the Building Code of Australia.

Other materials can be used either as the core of the shutter panels or the skin. In particular one or more composite materials could be used. One particularly preferred family of materials is composite fibre technology. Fibre-reinforced polymers or FRPs include carbon-fibre reinforced plastic or CFRP, and glass-reinforced plastic or GRP. If classified by matrix then there are thermoplastic composites, short fibre thermoplastics, long fibre thermoplastics or long fibre-reinforced thermoplastics. There are numerous thermoset composites, but advanced systems usually incorporate aramid fibre and carbon fibre in an epoxy resin matrix. Usually, these materials will be used as the skin of the shutter panels with the core of the panel being of honeycomb construction for strength whilst reducing weight.

Composites are made up of individual materials referred to as constituent materials. There are two categories of constituent materials: matrix and reinforcement. At least one portion of each type is required. Typically, most common polymer-based composite materials, including fiberglass, carbon fiber, and Kevlar, include at least two parts, the substrate and the resin as the matrix.

Polyvinyl chloride (PVC) could be used as the thermoplastic matrix in window applications (although other plastics are also employed). The fibre employed in windows and doors is usually 80- to 200-mesh wood fiber—this produces a wood-filled polyvinyl chloride (PVC) product, which offers thermal stability, moisture resistance, and stiffness.

Both vinyl and polyolefin (e.g. polyethylene and polypropylene) plastic resins could be used, either separately or in combination with wood flour to form exterior trim that resists rot and weathering. The resulting material can be moulded into a wide range of designs that typically do not require painting or the use of special cleaning agents.

High-end plastic composites could be used. By eliminating some of the performance concerns of commonly used materials, wood-plastic composite materials can offer a complete, virtually maintenance-free system.

Sandwich construction, another type of plastic composite structure which could be used combines a lightweight core material with laminated composite skins. Doors made of fiberglass reinforced plastic (FRP) skins surrounding rigid polyurethane foam or expanded polystyrene (EPS) cores are currently available for both residential and commercial projects. These composite sandwich doors offer high specific strength and stiffness, low weight, impact resistance, and uniform smooth or textured surfaces. The core stabilizes the facings and carries most of the shear load. (A low density core made of honeycomb or foam materials can provide structural performance with minimum weight.) Other considerations, such as sound insulation, heat resistance, and vibration-damping, dictate the choice of core material.

Another kind of sandwich is also finding its way into residential and commercial construction. Structural insulated panels (SIPs) feature a core of expanded polystyrene (or in some instances, extruded polystyrene [XPS] or polyisocyanurate [polyiso]) insulation sandwiched between two thin slices of OSB. The resulting floor/wall/roof panel is strong, lightweight, and can be designed to have exceptional insulation properties. Additionally, since they are manufactured components, SIPs can be delivered to the job site sized for a specific application, with wiring chases and provisions for plumbing rough-in machined or molded into the foam core and the OSB outer panel.

Fillers or additives can also be used to lend the final plastic composite attributes such as resistance to ultraviolet (UV) rays or fire resistance.

In an embodiment, the fire shutter comprises an upper panel hinged along an upper horizontal portion of the opening and a lower panel hinged along a lower horizontal portion of the opening. Preferably the upper and lower panels together can be configured to cover the opening in a closed state, and the upper panel alone is configurable as an awning in an open state.

The panels may be hinged from within a recess in a surface, preferably a wall, that the opening is within. Preferably when the panels are in the closed state they are contained within the recess with little or no extruding parts. When panels are in the open state, they are preferably at least partially (in a preferred embodiment, substantially) outside the recess and clear of the opening.

The join between the upper panel and the lower panel may be rebated (e.g. a rebated or stepped join). The join may be configured such that water, such as from rain, is prevented (or at least substantially inhibited) from entering the shutter. In an embodiment, the meeting ends of the upper panel and the lower panel each have a protruding portion that is received against an adjacent recessed portion in the other panel, and in a particularly preferred embodiment, the protrusion of the upper panel is on the exterior of the shutter and protrusion of the lower panel is on the interior of the shutter when the panels are in a closed state.

In an alternative embodiment, the lower panel may be pivotably connected to the upper panel, such that when opening the shutter, the lower panel folds relative to the upper panel to reside (at least substantially) adjacent the upper panel in the open state. Such an arrangement could also be used with the hinges along the vertical side of the panels, to cover a larger opening such as a sliding door.

Preferably, at least a portion of the edges of the panel have an intumescent coating. The intumescent coating is preferably an intumescent paint that is applied to at least the majority of the edges and/or joins of the panel(s). Where the panel is under severe heat, such as that caused by a nearby fire, the intumescent coating preferably expands or swells to seal the panel. Assuming the panel is in the closed state, the panel is preferably sealed in the opening to limit or prevent the fire, and preferably as much heat as possible, from passing into the opening.

The fire shutter may further comprise a mounting assembly. The mounting assembly may comprise a frame mounted within or adjacent the opening. Preferably, where there is a mounting assembly, the panels hinge from the mounting assembly. In an embodiment, the mounting assembly comprises a steel frame that substantially surrounds the perimeter of the opening.

Preferably the opening is a window and, even more preferably, the fire shutter is located on the exterior side of window panes. The window is preferably located in a wall and the recess preferably comprises at least a portion of the window frame. The panel(s) preferably have a latching or locking mechanism to latch/lock the panels in at least the closed state. The latching or locking mechanism can preferably be actuated from the inside.

The panel(s) may have one or more assistance mechanisms configured to assist in the opening and/or closing of the panels. The assistance mechanisms may comprise gas struts (particularly for the upper panel in a two panel embodiment), linkages, levers, electric motors, hydraulics, or the like. Preferably the panel(s) may be maintained in one or more states between the open and closed states (e.g. a partially open state). For instance, an upper panel may be maintained at different heights depending on, for example, the height of the sun, and the level of protection desired from the sun.

The fire shutter of the present invention also typically includes a structure or mechanism to retain the shutter, particularly an upper shutter, in the open position. One such structure is provision of a telescopic pneumatic strut which assists with opening of the shutter and retains the open shutter in position until forcibly closed.

Preferably however, the structure or mechanism to retain the shutter in the open position is one that allows the shutter to be closed quickly if a fire is looming and preferably is one that closes the shutter in response to fire conditions without actuation by a user. A preferred mechanism to accomplish this is to provide a retention mechanism to attach to an open shutter than retains the open shutter in the open condition against a biasing force. The biasing force can be a mechanically applied force such as applied by a spring or ram or the like and against which the shutter is held open or the force can be a natural force such as gravity against which the shutter is held open.

It is preferred that the biasing force is applied by gravity for simplicity.

It is further preferred that a trigger or actuation mechanism is provided such that in fire or potential fire conditions, the trigger or actuation mechanism can trigger release of the shutter and the biasing force will move the fire shutter to the closed condition.

One manner of achieving this is to suspend an open (upper) shutter from a portion above the window in respect of which the shutter is mounted using an elongate suspension assembly and the provision of at least one mechanical fusible link in the elongate suspension assembly such that as the temperature increases, such as when a fire front approaches, the fusible link separates and gravity forces the shutter into the closed condition.

A preferred mechanical fusible link is a device including two strips of metal soldered together with a fusible alloy that is designed to melt at a specific temperature, thus allowing the two pieces to separate. The fusible link will typically be located between two portions of an elongate wire, or other connector to suspend the open shutter, typically from the eaves of a building structure.

Depending upon the embodiment provided, only an upper shutter may be suspended or both shutters may be suspended particularly if the fire shutter is provided in the two or more leaf, pivotally connected embodiment.

Preferably the panel(s) are more than 20 mm thick and less than 100 mm thick. Even more preferably, the panel(s) are between 40 and 60 mm thick and, in a preferred embodiment, the panel(s) are approximately 50 mm thick. A typical wall section may be 200 mm thick, with the window pane(s) recessed by approximately 80 mm from the exterior surface. Preferably the panel(s) pivot between 45° and 180° between the closed and open states. In a preferred embodiment, the upper panel pivots between 45° and 135°, preferably 90° (between the closed state to the open state); and the lower panel pivots approximately 180° (between the closed state to the open state).

Preferably the shutter is full fire rated, exceeding, or at least meeting, the highest and/or most stringent fire safety ratings and standards. In this regard, the shutter preferably exceeds fire rating guidelines and requirements under the relevant Building Code for example, the Building Code of Australia (e.g. vol. 2 classes 1 and 10, building provisions for extreme bushfire areas).

In order that the invention may be more readily understood and put into practice, one or more embodiments thereof will now be described, by way of example only, with reference to the accompanying drawings.

DESCRIPTION OF PREFERRED EMBODIMENTS

Figure 1:
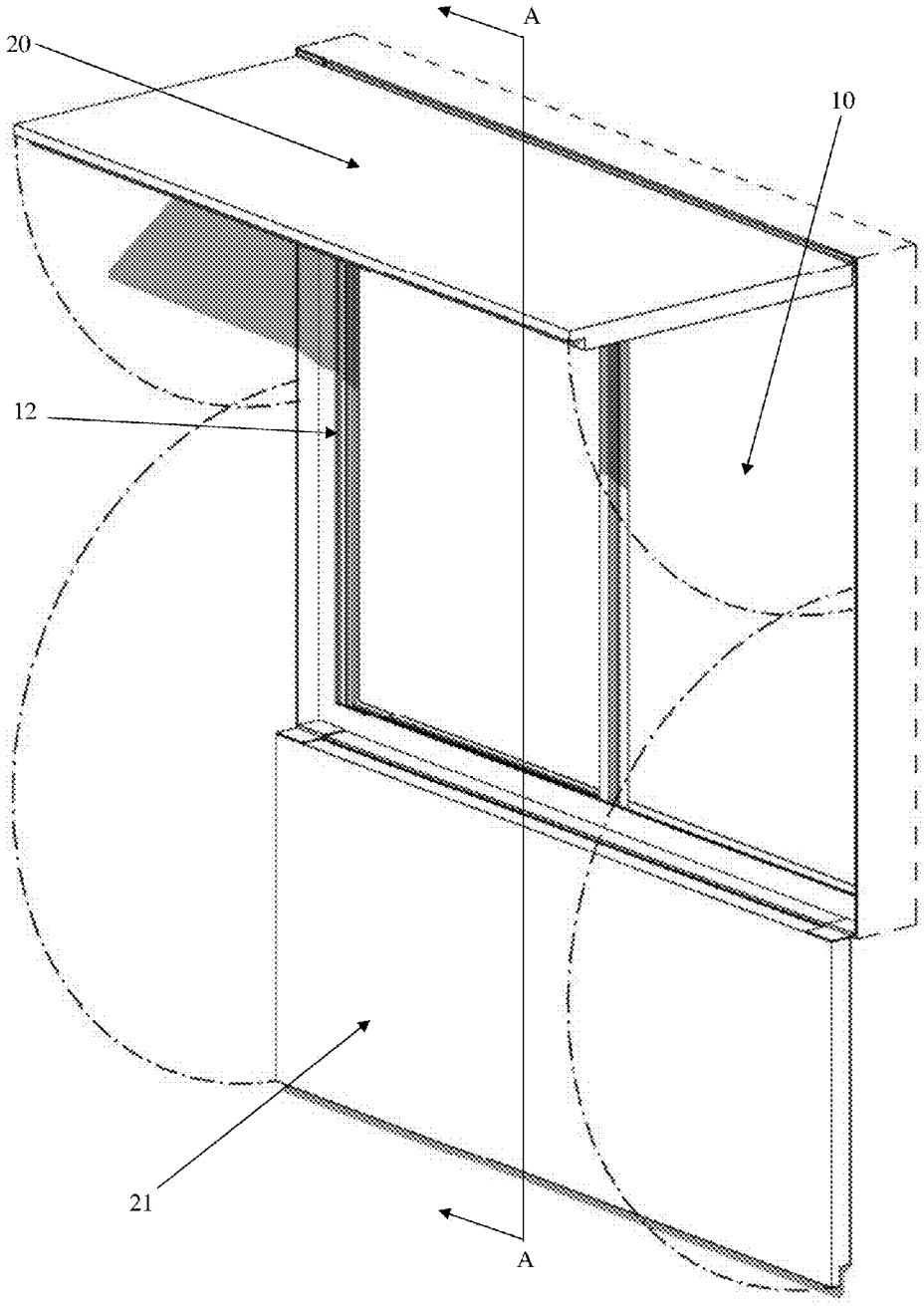
FIG. 1 illustrates a perspective view of an embodiment of the invention in an open state.

Illustrated in the figures are embodiments of the invention having an upper panel 20 and a lower panel 21 covering an opening 10 in a wall 11. The opening is a window with panes 12 that may operate in any suitable manner but, in the illustrated embodiments are typically illustrated as sliding windows comprising two adjacent panes. Although two panels 20 and 21 are illustrated, it will be appreciated that a single panel (typically similar to the upper panel 20) could be provided in isolation, and no limitation is meant thereby.

The panels 20 and 21 are generally planar rectangular members having a steel shell and an insulating, fire resistant, core 20' and 21'. The core 20' and 21' is made of a phenolic foam, which may have polystyrene beads contained therein. In a preferred embodiment the material is preferably RMAX POLYPHEN, which has been found to provide suitable structural and fire resistant properties.

Figure 2:
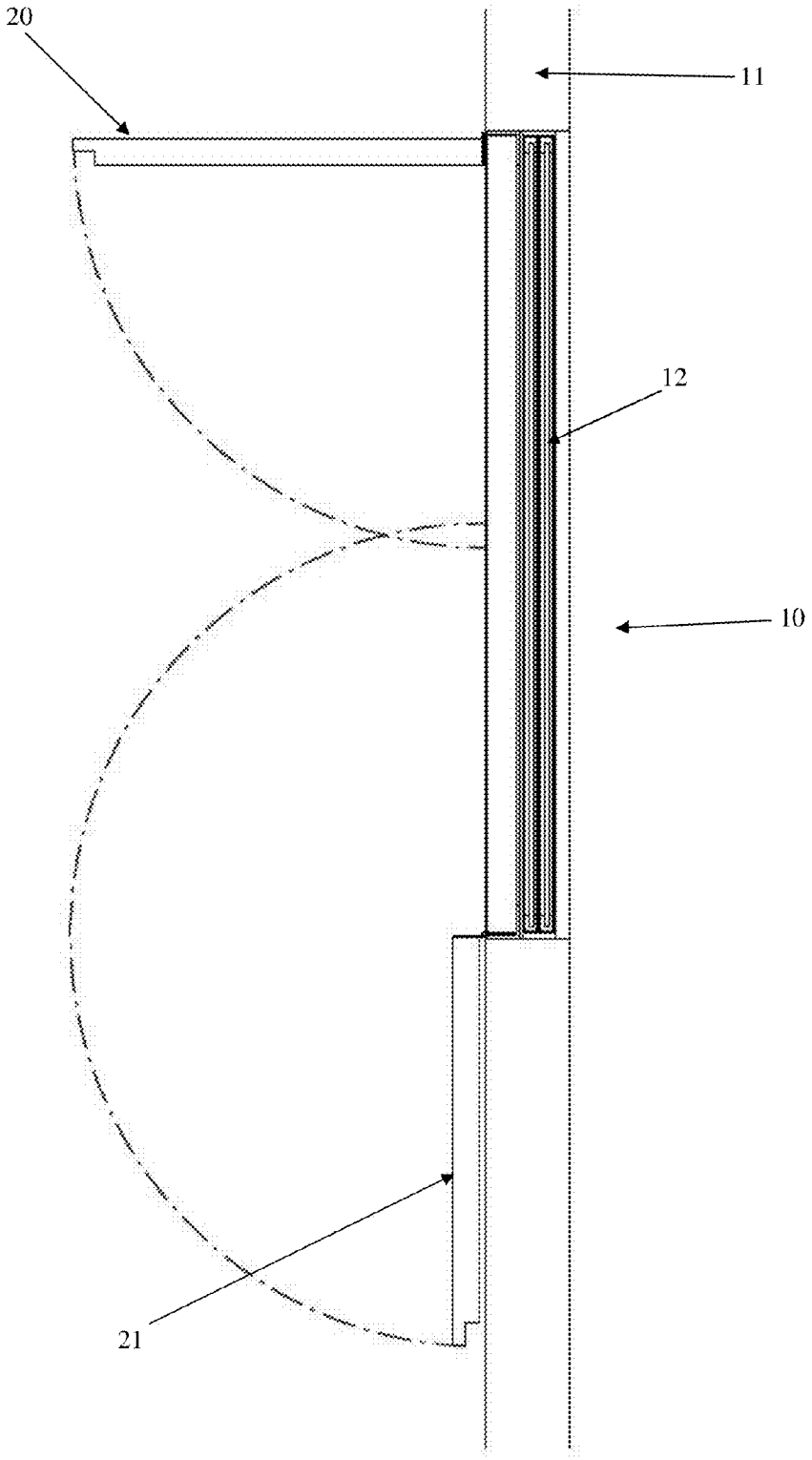
FIG. 2 illustrates a cross-sectional side elevation view of an embodiment of the invention in an open state, the cross-section along line A-A in FIG. 1.

The panels 20 and 21 are hinged along a horizontal (or at least substantially horizontal) edge of the opening 10. As illustrated in FIGS. 1 and 2, the panels 20 and 21 are in an open (or at least partially open) state. The upper panel 20 extends perpendicularly from the wall 11 and can be utilised as an awning for the opening 10. The lower panel 21 folds back and rests adjacent the wall 10, generally out of the way. However, it is envisaged that the lower panel 21 could also extend perpendicularly and be used as a shelf, bench, bar top, or the like.

Figure 3:
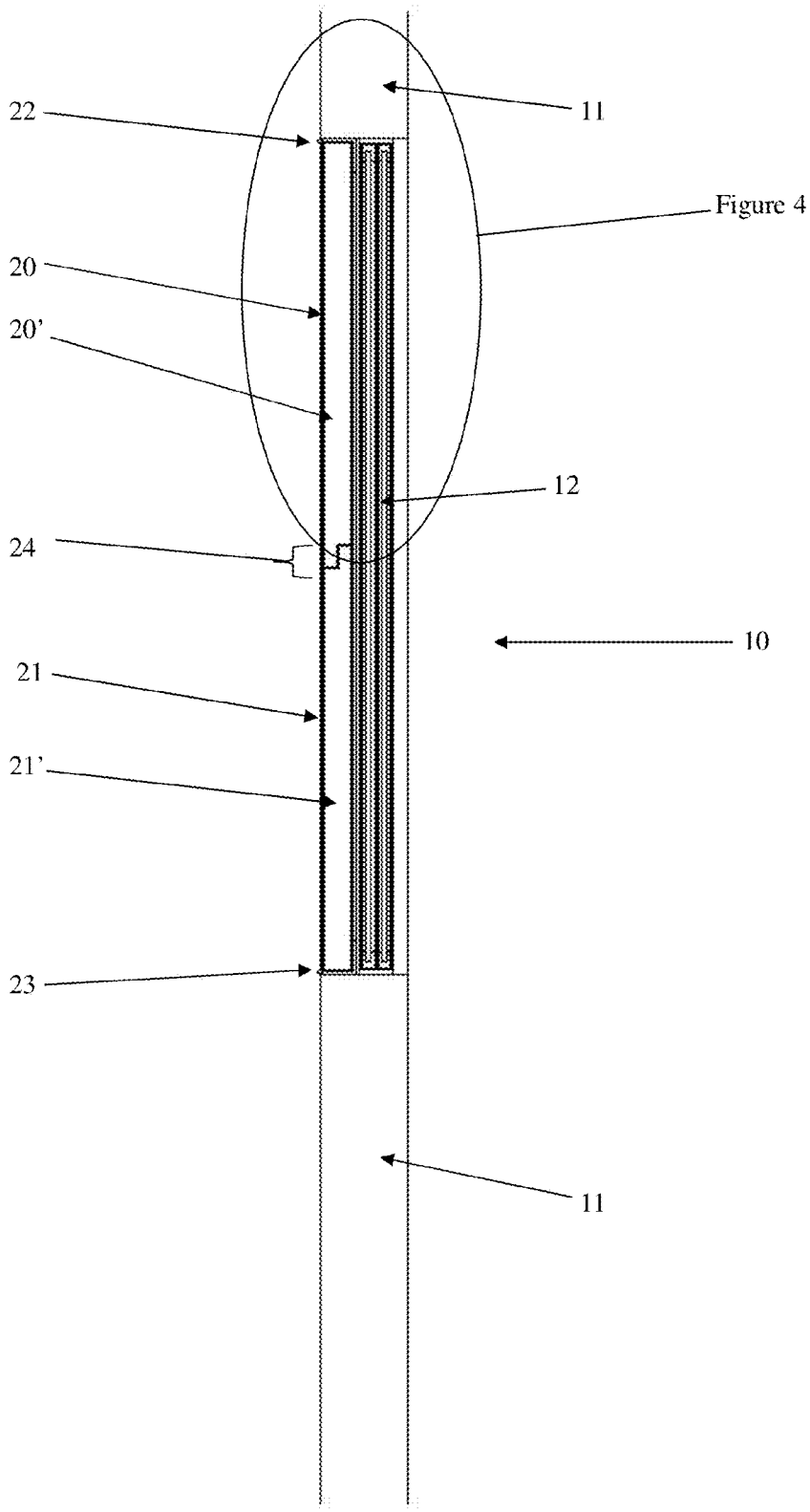
FIG. 3 illustrates a cross-sectional side elevation view of an embodiment of the invention in a closed state, the cross-section along line A-A in FIG. 1.
Figure 5:
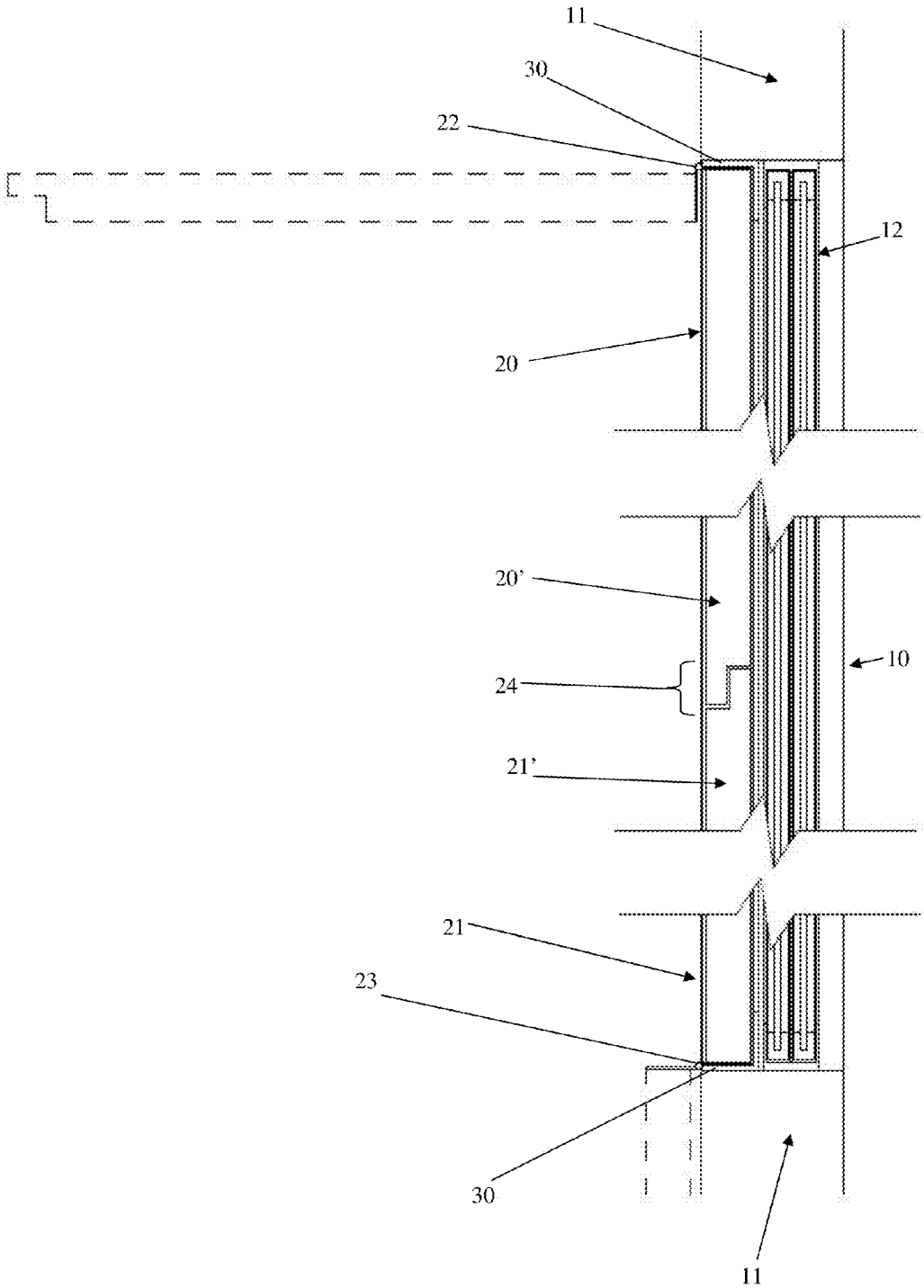
FIG. 5 illustrates a cross-sectional side elevation view of an embodiment of the invention in a closed state, the cross-section along line A-A in FIG. 1.

In the closed state, as illustrated in FIGS. 3 and 5, the panels 20 and 21 cover the opening. In the closed state, the shutter not only provides fire protection (e.g. from bushfires) but also provides thermal insulation, security, and can replace curtains, if desired. FIG. 5 not only illustrates the shutter in a closed state, but also illustrates preferred panel positions in an open state with the dashed lines.

As illustrated in FIG. 3, the panels 20 and 21 have a rebated join 24. The rebated join 24 provides a structural fit, as well as sealing one side of the panels from the other (i.e. the outside from the inside). The join 24 is configured such that the upper panel 20 has a protruding portion on the outer side that is received by a corresponding recessed portion in the lower panel 21. This ensures liquids, such as water, are unable to flow from the outside to the inside, at least not by gravity alone.

Figure 4:
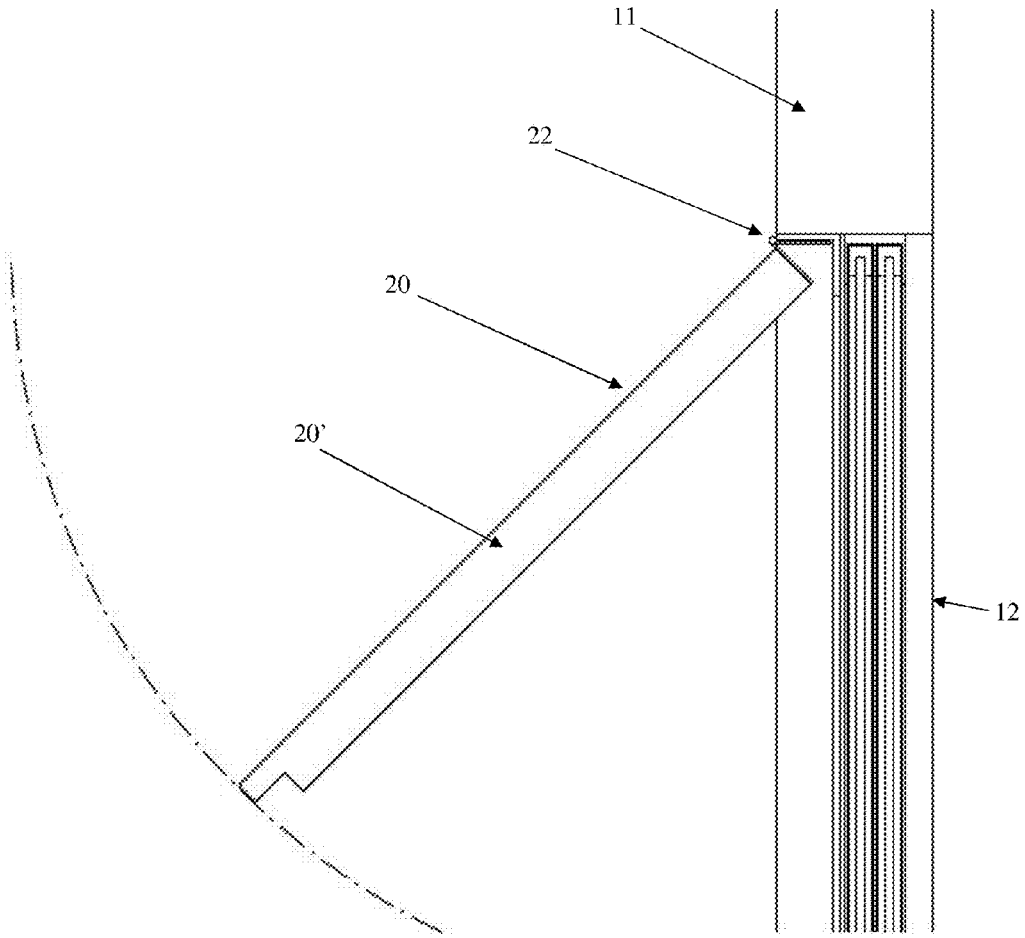
FIG. 4 illustrates a detailed cross-sectional side elevation view of a hinge portion as illustrated and indicated in FIG. 3.

The panels 20 and 21 are hinged to the wall 11 by respective hinges 22 and 23, most clearly illustrated in FIG. 4. The hinges are arranged to allow the panels 20 and 21 to pivot around the horizontal axis, as shown by the curved dashed lines in FIGS. 1 and 2. As illustrated by the dashed lines in FIG. 5, the upper panel 20 pivots approximately 90° about the upper hinge 22, and the lower panel 21 pivots approximately 180° about the lower hinge 23.

At least the upper panel 20 has a retention mechanism (not illustrated) to retain the panel in the open state. The mechanism preferably allows the panel to be retained at different angles, allowing the upper panel 20 to be utilised as an adjustable awning. The lower panel 21 may also have such a mechanism. The panels 20 and/or 21 preferably have an assistance mechanism to assist in moving/pivoting the panels 20 and 21. The assistance mechanism may be any suitable mechanism, but preferably comprises gas struts (not illustrated) which assist in countering the weight of the panels during movement.

The gas struts may also form at least part of the retention mechanism. For example, the gas strut may be utilised to assist in moving the upper panel 20 from the closed state (as illustrated in FIG. 5) to the open state (as illustrated in the dashed lines in FIG. 5). Then, when in the open state, the gas strut is capable of holding the weight of the panel and retaining the panel in the open state. Furthermore, the gas strut may allow the panel to be moved to a desired angle (in between the open and closed states, or possibly extending beyond the open and closed states) and held at that angle by the gas strut.

Figure 6:
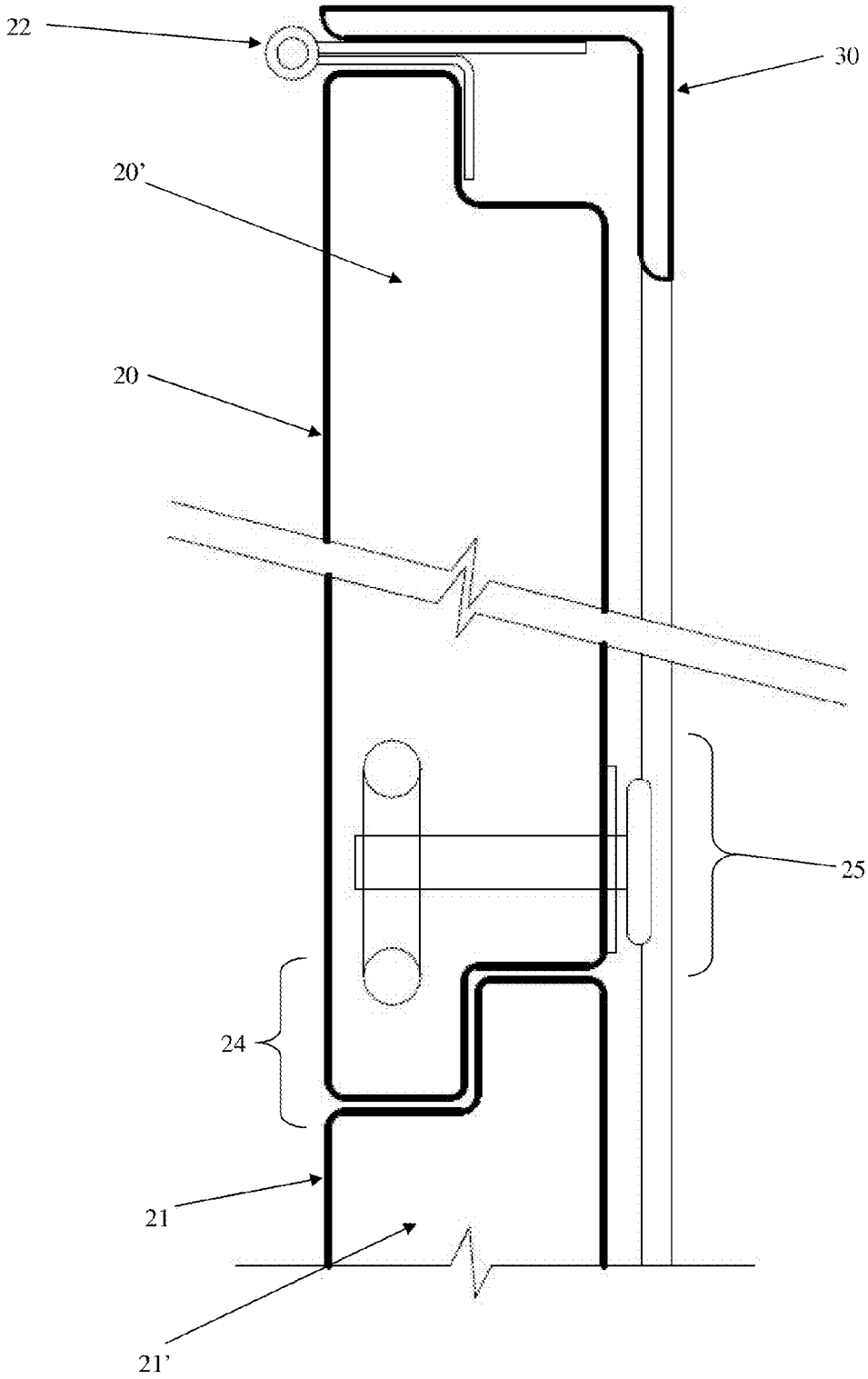
FIG. 6 illustrates a close up cross-sectional side elevation view of hinge and latching portions according to an embodiment of the invention, the cross-section along line A-A in FIG. 1.

A mounting assembly in the form of a frame 30 may be provided in the opening 10 to mount the hinges/panels thereon. The frame 30 is preferably made of steel and substantially traverses the perimeter of the window frame 10. The frame 30 is illustrated in FIGS. 5 and 6, and is utilised as a support for the hinges 22 and 23 to be attached thereto. The frame 30 is preferably made of right angle steel extrusions, with a portion that sits adjacent the wall 10 and a portion that extends perpendicularly from the wall 10. The frame 30 provides a stable secure support for the panels 20 and 21, protects the hinges 22 and 23, and ensures a good seal between the panels 20 and 21 and the wall 11.

A latching mechanism 25 may be provided (FIG. 6), which latches or locks the panels 20 and 21 in the closed state. The latching mechanism 25 may latch/lock each panel individually, and/or may latch/lock the two panels together. The latching mechanism 25 not only secures the opening 10 (e.g. from intruders), but also holds the panels in place in event of emergency to prevent the shutter being inadvertently opened.

Figure 7:
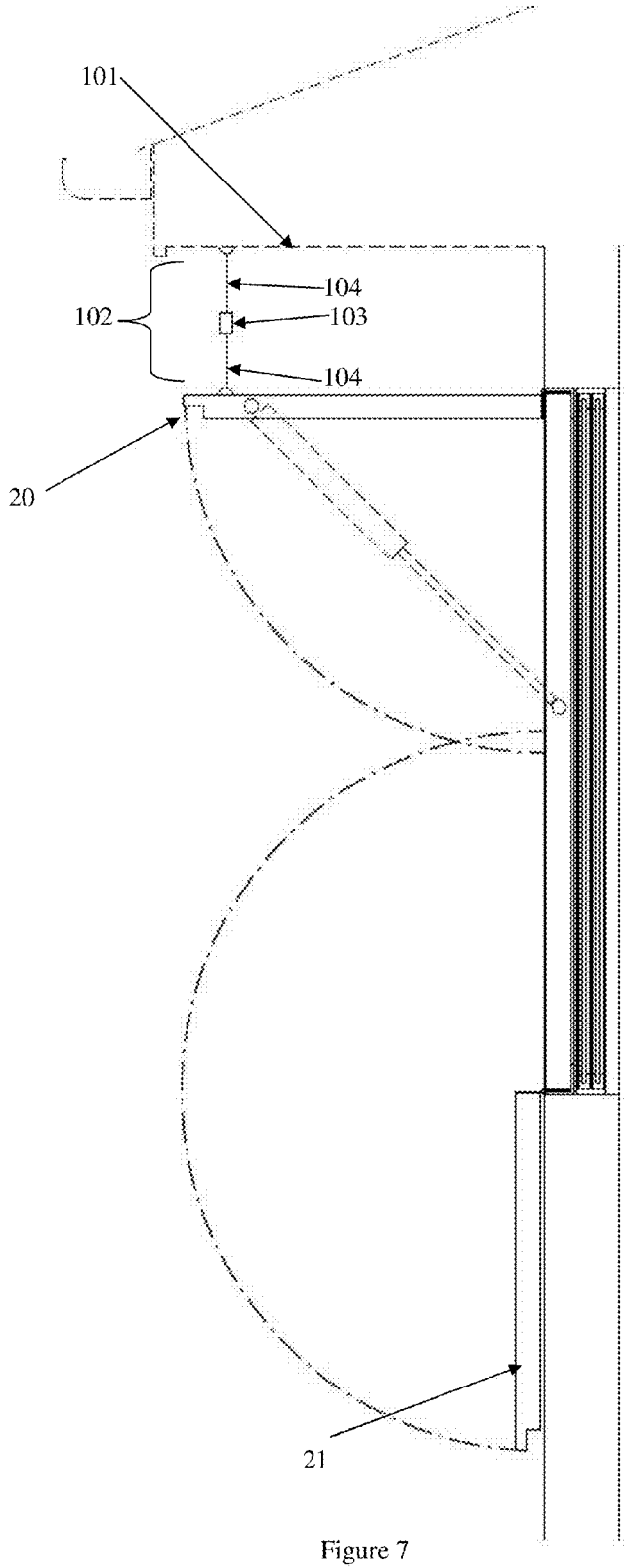
FIG. 7 illustrates a cross-sectional view of an alternative embodiment of the present invention showing methods of retaining the fire shutter in the open condition.

In an alternative embodiment of the present invention, a structure or mechanism to retain the shutter in the open position that allows the shutter to be closed quickly if a fire is looming may be provided. One form of structure or mechanism for this purpose is illustrated in FIG. 7. The preferred type of structure or mechanism is one that closes the shutter in response to fire conditions without actuation by a user.

The preferred mechanism to accomplish this is to provide a retention mechanism to attach to an open shutter that retains the open shutter in the open condition against the biasing force of gravity.

A trigger or actuation mechanism is provided in association with the retention mechanism such that in fire or potential fire conditions, the trigger or actuation mechanism can trigger release of the shutter and the biasing force will move the fire shutter to the closed condition.

One manner of achieving this is as illustrated in FIG. 7 and that is to suspend an open upper shutter 20 from a portion above the window in respect of which the shutter is mounted (in the illustrated embodiment from a portion of the overhanging eaves 101) using an elongate suspension assembly 102 and providing a mechanical fusible link 103 in the elongate suspension assembly 102 such that as the temperature increases, such as when a fire front approaches, the fusible link 103 separates and gravity forces the shutter 20 into the closed condition.

The fusible link 103 is preferably located between two portions of an elongate wire 104.

Depending upon the embodiment provided, only an upper shutter may be suspended or both shutters may be suspended particularly if the fire shutter is provided in the two or more leaves which are pivotally connected.

Figure 8A:
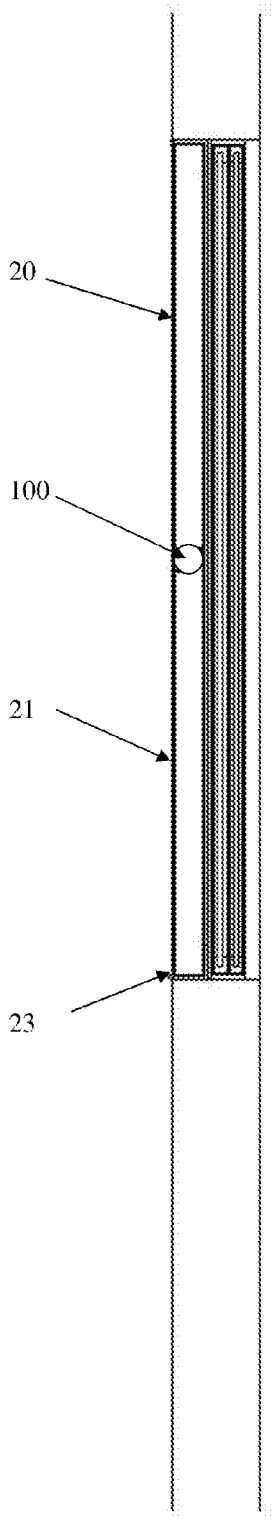
FIGS. 8A and 8B illustrate a cross-sectional side elevation views of a pivotally connected embodiment of the invention in a closed state, the cross-section along line A-A in FIG. 1.

Illustrated in FIG. 8A is a pivotal embodiment of the present invention in which the upper and lower panels 20, 21 are connected to one another at or along the lower edge of the upper panel 20 and the upper edge of the lower panel 21 by a hinge or similar pivot 100. The lower panel 21 is mounted using a hinge allowing the upper panel 20 to rotate about the pivot 100 as the lower panel rotates bout the hinge. This allows the panels to be located below and outside the window when not in use.

Figure 8B:
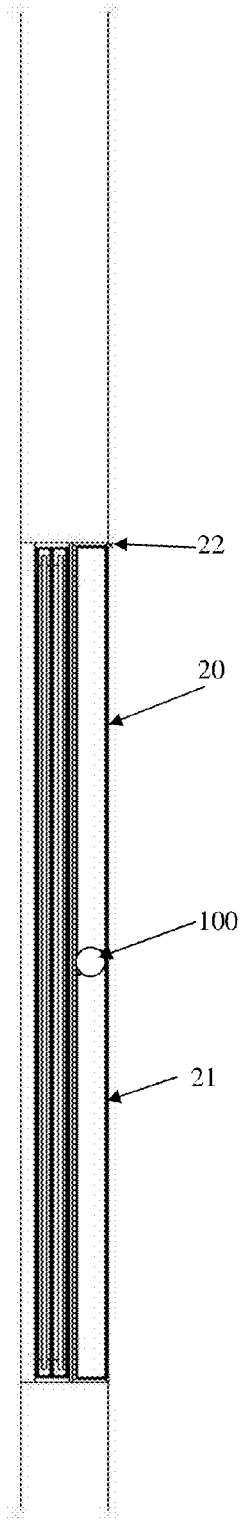

The reverse configuration is illustrated in FIG. 8B wherein the construction is the same as FIG. 8A however the upper panel 20 is hinged to the window surround using hinge 22 rather than the lower panel. In this configuration, the retention mechanism illustrated in FIG. 7 could be used to retain both shutter panels in the open condition rather than simply the upper panel 20.

Advantageously, the shutter is multi-purpose, being a high level fire rated shutter to protect the inside of the opening 10 from fires (e.g. bushfires), but also being able to be used as an awning, and a security and thermally insulating window covering. In the event of a fire, the shutter keeps embers and radiant heat out. When there is no risk of fire, the upper panel 20 can become an awning, and the lower panel 21 may sit out of the way against the wall 10. If desired, the panels may be put in the closed position to provide thermal insulation (e.g. to keep warmth in, or out) as well as a level of security, particularly from intruders who would not be able to simply break the window if it is covered by the panels.

It is to be understood that the terminology employed above is for the purpose of description and should not be regarded as limiting.

The foregoing embodiments are intended to be illustrative of the invention, without limiting the scope thereof. The invention is capable of being practised with various modifications and additions as will readily occur to those skilled in the art.

Accordingly, it is to be understood that the scope of the invention is not to be limited to the exact construction and operation described and illustrated, but only by the following claims which are intended, where the applicable law permits, to include all suitable modifications and equivalents within the spirit and concept of the invention.

Throughout this specification, including the claims, where the context permits, the term "comprise" and variants thereof such as "comprises" or "comprising" are to be interpreted as including the stated integer or integers without necessarily excluding any other integers.

What is claimed is:

1. A fire shutter for an opening, the fire shutter comprising at least one fire resistant upper panel having an insulating core, and at least one fire resistant lower panel having an insulating core, wherein the at least one fire resistant upper panel is hinged along an upper horizontal portion of the opening, and the at least one fire resistant lower panel is hinged along a lower horizontal portion of the opening, and wherein the panels are configured to cover the opening in a closed state and the at least one upper panel is configurable as an awning in an open state, wherein the at least one fire resistant upper panel has a suspension mechanism attached thereto with an end to be attached to a remote support surface to hold the at least one fire resistant upper panel in the open condition, the suspension mechanism includes a first elongate suspension member secured to the remote support surface, a second elongate suspension member secured to the at least one fire resistant upper panel, and a fusible link disposed between and secured to the first elongate suspension member and the second elongate suspension member, the fusible link being configured to separate at a predetermined elevated temperature to allow the at least one fire resistant upper panel to move to the closed condition due to gravity.

2. A fire shutter for an opening as claimed in claim 1 wherein at least one of the at least one fire resistant lower panel and the at least one fire resistant upper panel is provided with an at least partially rigid outer casing or shell.

3. A fire shutter for an opening as claimed in claim 1 wherein at least one of the at least one fire resistant lower panel and the at least one fire resistant upper panel is provided with an insulating core.

4. A fire shutter for an opening as claimed in claim 3 wherein the at least one of the at least one fire resistant lower panel and the at least one fire resistant upper panel further includes an at least partially rigid outer casing or shell wherein the insulating core substantially fills the outer casing or shell.

5. A fire shutter for an opening as claimed in claim 1 wherein each of the at least one fire resistant lower panel and the at least one fire resistant upper panel is hinged from a non-vertical surface defining the opening.

6. A fire shutter for an opening as claimed in claim 5 wherein when the panels are in the closed state they are contained within the opening inside a first plane on one side of a wall and a second plane on an opposite side of a wall in which the opening is formed.

7. A fire shutter for an opening as claimed in claim 1 wherein the at least one fire resistant lower panel and the at least one fire resistant upper panel are configured to partially overlap when in a closed condition.

8. A fire shutter for an opening as claimed in claim 7 wherein a partial thickness rebate is provided on an edge of each panel, the respective rebates overlapping when in a closed condition.

9. A fire shutter for an opening as claimed in claim 8 wherein the at least one fire resistant upper panel is provided with a rebate on an internal side of the edge and the at least one fire resistant lower panel is provided with a rebate on an external side of the edge.

10. A fire shutter for an opening as claimed in claim 1 wherein at least a portion of edges of each panel has an intumescent coating.

11. A fire shutter for an opening as claimed in claim 10 wherein the intumescent coating is an intumescent paint applied to a majority of edges and joins of at least one of the at least one fire resistant lower panel and the at least one fire resistant upper panel.

12. A fire shutter for an opening as claimed in claim 1 wherein the fire shutter includes a mounting assembly including a frame mounted within or adjacent the opening, at least one of the at least one fire resistant lower panel and the at least one fire resistant upper panel being hinged from the mounting assembly.

13. A fire shutter for an opening as claimed in claim 12 wherein the at least one of the at least one fire resistant lower panel and the least one fire resistant upper panel has a latching mechanism to latch or a locking mechanism to lock the panel in at least a closed state.

14. A fire shutter for an opening as claimed in claim 1 wherein the at least one fire resistant upper panel has one or more assistance mechanisms configured to assist in the opening and closing of the at least one fire resistant upper panel.

15. A fire shutter for an opening as claimed in claim 1 wherein a retention mechanism is provided to attach to the at least one fire resistant upper panel to retain the at least one fire resistant upper panel in an open condition against a biasing force, and a trigger or actuation mechanism is provided to trigger release of the at least one fire resistant upper panel to allow the biasing force to move the at least one fire resistant upper panel to the closed condition.

16. A fire shutter for a window or opening in a wall, the fire shutter comprising a fire resistant upper panel having an insulating core and being hinged in use to pivot about a first horizontal axis adjacent an upper portion of the opening, the upper panel being configured for use as awning when in an open state, a fire resistant lower panel having an insulating core and being hinged in use to pivot about a second horizontal axis spaced below the first horizontal axis, wherein the panels are configured to cover the opening when in a closed state, and a suspension mechanism attached the fire resistant upper panel and to a remote support surface to hold the fire resistant upper panel in the open condition, the suspension mechanism includes a first elongate suspension member secured to the remote support surface, a second elongate suspension member secured to the at least one fire resistant upper panel, and a fusible link disposed between and secured to the first elongate suspension member and the second elongate suspension member, the fusible link being configured to separate at a predetermined elevated temperature to allow the at least one fire resistant upper panel to move to the closed condition due to gravity.

* * * * *